US005746142A

United States Patent [19]

Jennebach et al.

[11] Patent Number: 5,746,142

[45] Date of Patent: May 5, 1998

[54] HORIZONTALLY PIVOTED SYSTEM GRATE FOR A FURNACE

[75] Inventors: Markus Jennebach, Dachau, Germany; Joao Augusto Birkhan, Viamao-RS, Brazil

[73] Assignees: Leslie Technologies, Inc., Tallahassee, Fla.; Gruntec LTDA, Brazil

[21] Appl. No.: 746,641

[22] Filed: Nov. 13, 1996

Related U.S. Application Data

[62] Division of Ser. No. 399,847, Mar. 7, 1995, Pat. No. 5,588,381.

[51] Int. Cl.[6] ..... F23G 5/00; F23G 5/24

[52] U.S. Cl. ..... 110/248; 110/255; 110/267; 110/268; 110/275

[58] Field of Search ..... 110/268, 275, 110/276, 277, 285, 328, 247, 248, 255

[56] References Cited

U.S. PATENT DOCUMENTS

| | | | |
|---|---|---|---|
| 814,650 | 3/1906 | Harcharick | 110/275 |
| 1,173,693 | 2/1916 | Wingen | 110/275 |
| 1,903,634 | 4/1933 | Robinson | 110/275 |
| 1,984,045 | 12/1934 | Steere | 110/328 |
| 2,017,340 | 10/1935 | Corbett | 110/275 |
| 2,289,347 | 7/1942 | Daae | 110/275 |
| 2,393,422 | 1/1946 | Schneider | 110/275 |
| 2,747,526 | 5/1956 | Seidl | 110/28 |
| 3,645,218 | 2/1972 | Davis | 110/8 R |
| 4,026,223 | 5/1977 | Robbins | 110/7 B |
| 4,116,136 | 9/1978 | Mallek et al. | 110/251 |
| 4,184,437 | 1/1980 | Mallek et al. | 110/251 |
| 4,194,455 | 3/1980 | Mallek et al. | 110/251 |
| 4,261,269 | 4/1981 | Mallek et al. | 110/251 |
| 4,424,755 | 1/1984 | Caffyn et al. | 110/246 |
| 4,498,909 | 2/1985 | Milner et al. | 48/209 |
| 4,516,510 | 5/1985 | Basic, Sr. | 110/346 |
| 4,544,374 | 10/1985 | Mallek et al. | 48/114 |
| 4,561,363 | 12/1985 | Mallek | 110/229 |
| 4,655,146 | 4/1987 | Lemelson | 110/346 |
| 4,700,637 | 10/1987 | McCartney | 110/237 |
| 4,785,746 | 11/1988 | Roy et al. | 110/347 |
| 4,800,824 | 1/1989 | DiFonzo | 110/235 |
| 4,800,825 | 1/1989 | Kuenzly | 110/345 |

(List continued on next page.)

FOREIGN PATENT DOCUMENTS

| | | |
|---|---|---|
| 451095 | 9/1948 | Canada . |
| 1673783 A1 | 8/1991 | U.S.S.R. . |

*Primary Examiner*—Ira S. Lazarus
*Assistant Examiner*—Ljiljana V. Ciric
*Attorney, Agent, or Firm*—Leonard Bloom

[57] ABSTRACT

A low-pollutant system for waste materials treatment includes a process chamber for converting organic components of the waste materials into a flammable gas and a two-stage vortex burning chamber for complete combustion of the flammable gas. The vortex burning chamber includes a first substantially-horizontal combustion chamber and a second substantially-vertical combustion chamber disposed at a right angle to each other and communicating therebetween. The first combustion chamber has an inlet portion for receiving the flammable combustion gas from the gas generator means for injecting primary air into the first combustion chamber, thereby forming a mixture of air and the flammable gas and thereby igniting the mixture for partial oxidation thereof. The first combustion chamber has a converging distal portion for discharging the partially-oxidized mixture of air and the flammable gas tangentially into the second combustion chamber, where the gas is mixed with the secondary air which is injected tangentially into the second combustion chamber, thereby substantially completely oxidizing the partially-oxidized mixture of air and the flammable gas. The second combustion chamber has an outlet portion for discharge of the waste gas resulting from the two-stage combustion of the flammable gas and the solids separated from the gas. The system has a pivoting grate with an angled flat roof with slots and paddles; and a coke bed for the cracking of pyrolysis of gases disposed under said roof.

1 Claim, 6 Drawing Sheets

U.S. PATENT DOCUMENTS

| | | | |
|---|---|---|---|
| 4,873,930 | 10/1989 | Egense et al. | 110/345 |
| 4,898,692 | 2/1990 | Rajan et al. | 252/629 |
| 4,920,898 | 5/1990 | Solbes et al. | 110/265 |
| 5,022,329 | 6/1991 | Rackley et al. | 110/234 |
| 5,042,400 | 8/1991 | Shiraha et al. | 110/244 |
| 5,052,312 | 10/1991 | Rackley et al. | 110/346 |
| 5,209,187 | 5/1993 | Khinkis | 122/136 R |
| 5,588,381 | 12/1996 | Jennebach et al. | 110/345 |

HORIZONTALLY PIVOTED SYSTEM GRATE FOR A FURNACE

This application is a division of application Ser. No. 08/399,847, filed Mar. 7, 1995 and now U.S. Pat. No. 5,588,381.

FIELD OF THE INVENTION

The present invention relates to a process and an apparatus for the complete burning of waste materials and, more particularly, to a process and an apparatus wherein the lean gas is produced in a process chamber and combusted in a two-stage vortex burning chamber with concurrent separation of solids carried therealong.

BACKGROUND OF THE INVENTION

The problem of consumer and medical waste and the residues of industrial production, resulting in environmental pollution, is one of the most significant factors causing serious health problems throughout the world. These wastes include, but are not limited to, plastics, contaminated and natural wood wastes, infectious hospital wastes, rubber tires, electronic wastes, etc.

Concerned institutions and individuals are continually looking for economical environmentally-safe solutions for waste disposal.

For example, U.S. Pat. No. 4,116,136, 4,184,437, 4,194,455, 4,261,269, 4,544,374, and 4,561,363 disclose methods and apparatuses for burning waste materials, and particularly, to methods and furnaces wherein the waste is burned and the combustion of the gases formed by pyrolysis takes place in a separate one-compartment combustion chamber.

In the combustion of gases given off by heating the waste, it is very desirable that these gases be burned as completely as possible, thereby avoiding the escape of residual gases which are potentially harmful to the environment.

None of these prior art patents, however, discloses a multi-compartment vortex burning chamber which would allow separation of the solid particles carried by the lean gas and a complete burning of the lean gas, such that the escape of residual gases and the resulting pollution to the environment is substantially minimized if not eliminated altogether. Such a method and system would be very desirable in the disposal of waste materials by combustion.

With this in mind, it is noted that in the technology relating to cyclone furnaces, multiple combustion chambers are well known; however, these cyclone furnaces have not been applied to the complete combustion of lean gases.

For example, in the U.S. Pat. No. 2,747,526, a cyclone furnace for ash-containing solid fuels is disclosed, wherein one or more primary cyclone type combustion chambers are positioned with horizontally extending axes. A tangential fuel and air inlet is provided at (or adjacent to) one end thereof; a tangential top outlet is provided for the gaseous products of combustion; and a bottom outlet is provided for separated molten slag. The products of combustion are discharged tangentially into a second similar fluid cooled cyclone chamber which is arranged with its longitudinal axis at right angles to the axis of the first combustion chamber.

U.S. Pat. Nos. 5,022,329 and 5,052,312 are concerned with a cyclone furnace for hazardous waste incineration and ash vitrification, such that organic hazardous substances are completely destroyed. The municipal waste is delivered to the furnace, and a controlled amount of air is provided through various ports to allow optimum combustion conditions. Bottom and fly ash is formed in the combustion process. The bottom ash is removed from the bottom of the boiler to an ash tank, and the fly-ash is transported to the burner of the cyclone furnace for subsequent vitrification.

The cyclone furnace fires into a secondary furnace which includes a flow restriction to provide gas recirculation and increase residence time for greater destruction of refractory organics and to increase the retention of fine organic particles in the slag. The cyclone furnace is oriented tangentially to the secondary furnace. This orientation increases the combustion gas residence time and inorganic particulate collection efficiency of the slag layer in the secondary furnace.

Although having multi-chamber burners, the latter three patent references disclose cyclone furnaces which need temperatures above the ash fuel temperature, i.e. 2100° F.–2700° F. to create a slag and are not intended for, nor applicable to, the combustion of lean gas (including pyrolysis gas) having a low calorific value. Besides, the diversified multi-chambered burners do not provide for a separation of dust carried along the lean gas. Furthermore, the equipment needs a sophisticated cleaning means.

SUMMARY OF THE INVENTION

The present invention avoids the disadvantages and deficiencies of the prior art by providing a sophisticated burning system, wherein the waste materials are completely combusted with extremely low emissions to the atmosphere, and wherein no slag is generated.

It is, therefore, an object of the present invention to provide a multi-stage low-temperature carbonization plant in which the solid organic wastes are dried, degassed and gasified, and in which the produced lean gas is completely burnt with no emissions.

It is another object of the present invention to provide a multi-stage low temperature carbonization plant in which the lean gas is burned in a two-stage vortex burning chamber.

It is yet another object of the present invention to provide a two-stage vortex burning chamber having two burning chambers arranged at right angle to each other and having different combustion conditions for gases to be burned, such that the gas is burned in a step-wise process.

It is a further object of the present invention to provide a system grate of a new and improved design enabling the homogenization of wastes to be burned.

In accordance with the teachings of the present invention, a low-pollutant system for waste materials treatment is provided, wherein the system includes a process chamber for converting organic components of the waste materials into a flammable gas, and further includes a two-stage vortex burning chamber for combustion of this flammable gas. The two-stage vortex burning chamber is connected upstream of the process chamber.

The vortex burning chamber includes a first substantially horizontal combustion chamber and a second substantially vertical combustion chamber disposed at a right angle to each other and communicating therebetween. The first combustion chamber has an inlet portion for receiving the flammable combustion gas from the process chamber, and further has a plurality of inlets for injecting primary air into the first combustion chamber, thereby forming a mixture of air and the flammable gas, and thereby igniting the mixture for partial oxidation thereof. The first combustion chamber has a converging distal portion for discharging the partially-oxidized mixture of air and the flammable gas tangentially into the second combustion chamber. Secondary air is injected tangentially into the second combustion chamber for substantially completely oxidizing the partially-oxidized mixture of air and the flammable gas. The second combustion chamber has an outlet portion for discharge of the waste gas resulting from the two-stage combustion of the flammable gas.

The process chamber includes a vertical furnace with a temperature gradient provided therealong. A top portion of the furnace has the lowest temperature, approximately (120° F.), and a bottom portion of the furnace has the highest temperature, approximately (1,470° F.). Waste materials are received at the top portion of the vertical furnace and fall to the bottom portion. The waste materials are thereby subjected to successively drying, degassing and gassifying, resulting in producing carbon, ashes and inert materials, and also incompletely burnt gas.

A system grate is mounted in the lower third of the vertical furnace. This grate, which is pivoted on a revolving axle, includes a 30°-angled roof with a plurality of slots and a plurality of paddles mounted on the roof. Respective spaces are arranged around the system grate between the system grate and internal walls of the vertical furnace.

An ash after-burning chamber is provided underneath the system grate, wherein the carbon, ashes and inert matters (resting on the system grate) are conveyed through the slots in the roof and the respective spaces around the system grate in the ash after burning.

The system grate includes a gasification zone and a coke bed.

The incompletely burnt gas is flammable with a low calorific value.

Preferably, each of the chambers of the vortex burning chamber is substantially cylindrical, and the second chamber has an ash-collecting compartment in a lower portion of enlarged cross-section. The outlet portion in the second chamber is in an upper portion of the second chamber and diverges outwardly therefrom.

In a preferred embodiment, the temperature in the first chamber is approximately 1600° F., and the temperature in the second chamber is approximately 1850° F.

Viewed in yet another aspect, the present invention provides an apparatus for burning waste material, wherein the apparatus does not produce slag, wherein substantially reduced operating temperatures are utilized, and wherein the resulting gases can be discharged to the atmosphere at substantially reduced environmental pollution. To meet these objectives, the apparatus includes a vertical furnace having a top portion, an intermediate portion, and a bottom portion, respectively; and means are provided for delivering waste materials to the top portion of the furnace, such that the waste materials pass through the furnace and are substantially heated. A grate is disposed within the intermediate portion of the furnace through which the heated waste materials are passed, thereby producing ashes which fall to the bottom portion of the furnace for subsequent removal, and thereby further producing a flammable gas mixture (lean gas, which is the mixture of the pyrolysis gas and the carbon monoxide gas). A two-stage vortex combustion chamber is provided, including a first substantially-horizontal chamber for receiving and partially oxidizing the flammable gas mixture, and further including a second substantially-vertical chamber communicating with the first chamber for substantially completely oxidizing the flammable gas mixture. Means are provided for generating a vortex action in the second chamber as the partially-oxidized flammable gas mixture is discharged from the first chamber into the second chamber; and further means are provided for introducing primary air or oxygen into at least one of the chambers in the two-stage vortex combustion chamber, wherein the resulting gas discharged from the two-stage vortex combustion chamber is relatively free of pollutants.

These and other objects of the present invention will become apparent from a reading of the following specification taken in conjunction with the enclosed drawings.

DETAILED DESCRIPTION OF THE INVENTION

Figure 1:
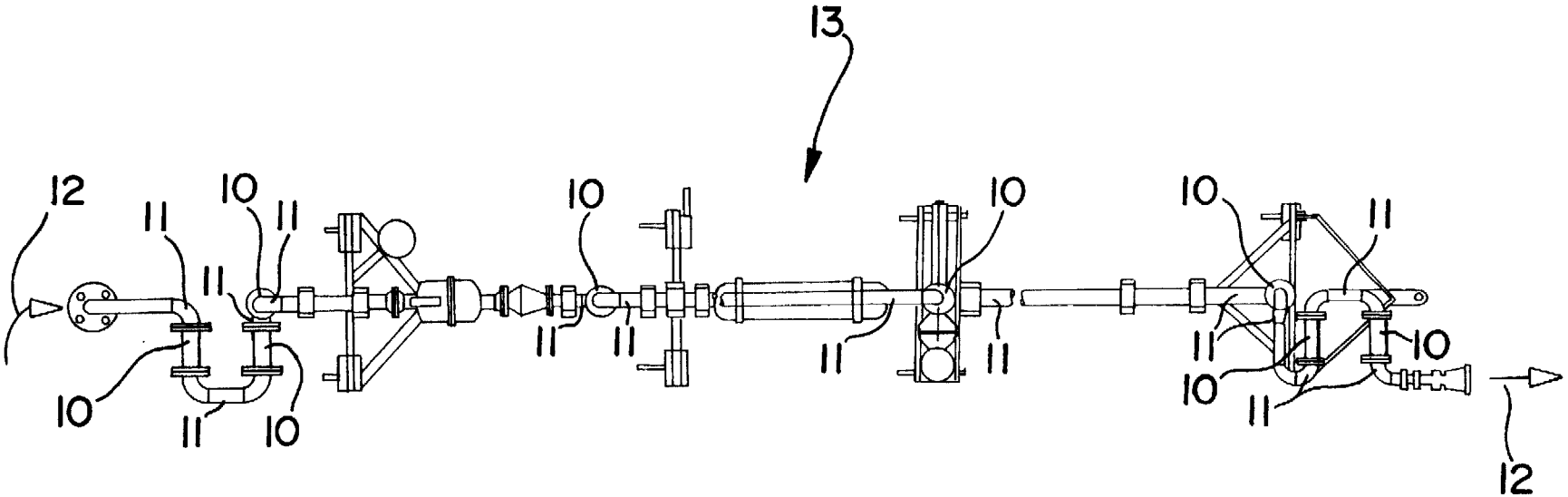
FIG. 1 is a schematic perspective view of an energy processor with which the teachings of the present invention may find more particular utility.

The present invention may find more particular utility if used in conjunction with an energy processor which basically comprise three major components: a process chamber, a two-stage-Vortex burning chamber and an off gas recirculation system.

The process chamber of the energy processor converts organic components into flammable gases at low temperatures. Non-organic, i.e. inflammable parts, are removed from the lower portion of the process chamber and can easily be disposed of and recycled. The vortex burning chamber separates the flammable gases from dust particles and burns them completely in a multi-stage secondary air supply, while keeping pollutants low.

In contrast to conventional equipment heretofore resorted to in the prior art, only low dust flue gas reaches the chamber. This way, expensive filters and cleaning equipment are eliminated. The temperature can be regulated from 1800° F. to 2200° F. The off gas recirculation system guarantees low temperature levels in the process chamber and serves to reduce nitrogen oxide build-up.

With reference to FIGS. 1–6, the system 10 of the present invention for waste treatment includes a process chamber 11 and a two-state vortex burning chamber 12 connected to the process chamber 11. The process chamber 11 has a vertical furnace 13, which is loaded through a sluice 14 in the upper portion 15 of the vertical furnace 13. An operator (is not shown) opens the top cover 16 of the sluice 14 and loads waste materials 17. Once the waste material 17 loaded, the top cover 16 is closed tightly, an internal flap 18 opens to feed the waste materials 17 into the vertical furnace 13, where they are run through several successive temperature zones. A temperature gradient is created along the length of the vertical furnace 13, such that in the upper portion 15 the temperature is 120° F., and in a lower portion 20 the temperature is 1470° F. While running through the temperature gradient, the waste materials 17 go through a reception zone 21, drying zone 22, decomposition zone 23, gassification zone 24 and oxidation zone 25, in sequence. A decomposition process which takes place in the decomposition zone 23 means the decomposition (degassing process) of dried waste material in long-chain hydrocarbon molecules (pyrolysis gas) and pure carbon. For this process only heat is required (no oxygen). After the waste materials 17 are dried and degassed, carbon, ashes, inert materials and gaseous products are produced.

The resulting carbon is then gasified. The gasification process which takes place in the gasification zone 24 (happens after the decomposition/degassing process) means the following exothermic reaction between carbon and oxygen of the primary air:

$$2C+O_2=2CO+\text{ energy}$$

This exothermic reaction provides the required energy (heat) for the degassing process. The oxygen ($O_2$) is supplied to the process chamber 11 by addition of substoichometric quantities of air to the waste materials 17.

Ashes and inert matters fall through a gap 27 between the system grate 26 and internal walls 28 of the vertical furnace 13 into a module 30 located underneath the system grate 26, where the ashes and inert matters are burnt out. In a bottom part 30 of the process chamber 11 there is an opening 31 through which the ashes are removed by means known by those skilled in the art at the end of the treatment cycle. An incompletely burnt gas, formed in the upper portion 15 of the vertical furnace 13 includes the pyrolysis gas (as the result of the degasification) and the carbon monoxide gas CO (as the result of the gasification). The oxidation of the gaseous products starts underneath the system grate 26 and in the first (horizontal) chamber 35 of the two-stage vortex burning chamber 12. The system grate 26 includes the gasification zone 24 (reaction between carbon and oxygen resulting in carbon monoxide) and a coke bed 33, where the pyrolysis gases (long-chain hydrocarbon molecules) resulting in the degassing process, are cracked to form short-chain hydrocarbon molecules (methane) and hydrogen ($H_2$).

The coke bed 33 consists of pure carbon, produced during the degassing process where the long-chain hydrocarbon molecules are broken into short-chain hydrocarbon molecules. After the cracking process, the gas contains approximately 70% of CO, 25% of $CH_4$ and 5% $H_2$.

After passing the cracking zone, beneath the system grate 26, the incompletely burnt gas 32 arrives the two-stage vortex burning chamber 12 through an outlet 34 in the process chamber 11.

The two-stage vortex burning chamber 12 is intended for the multi-stage combustion of gas of pyrolysis and/or lean gas—flammable gas with a low calorific value produced in the process chamber—with concurrent separation of solids carried along.

Figure 2:
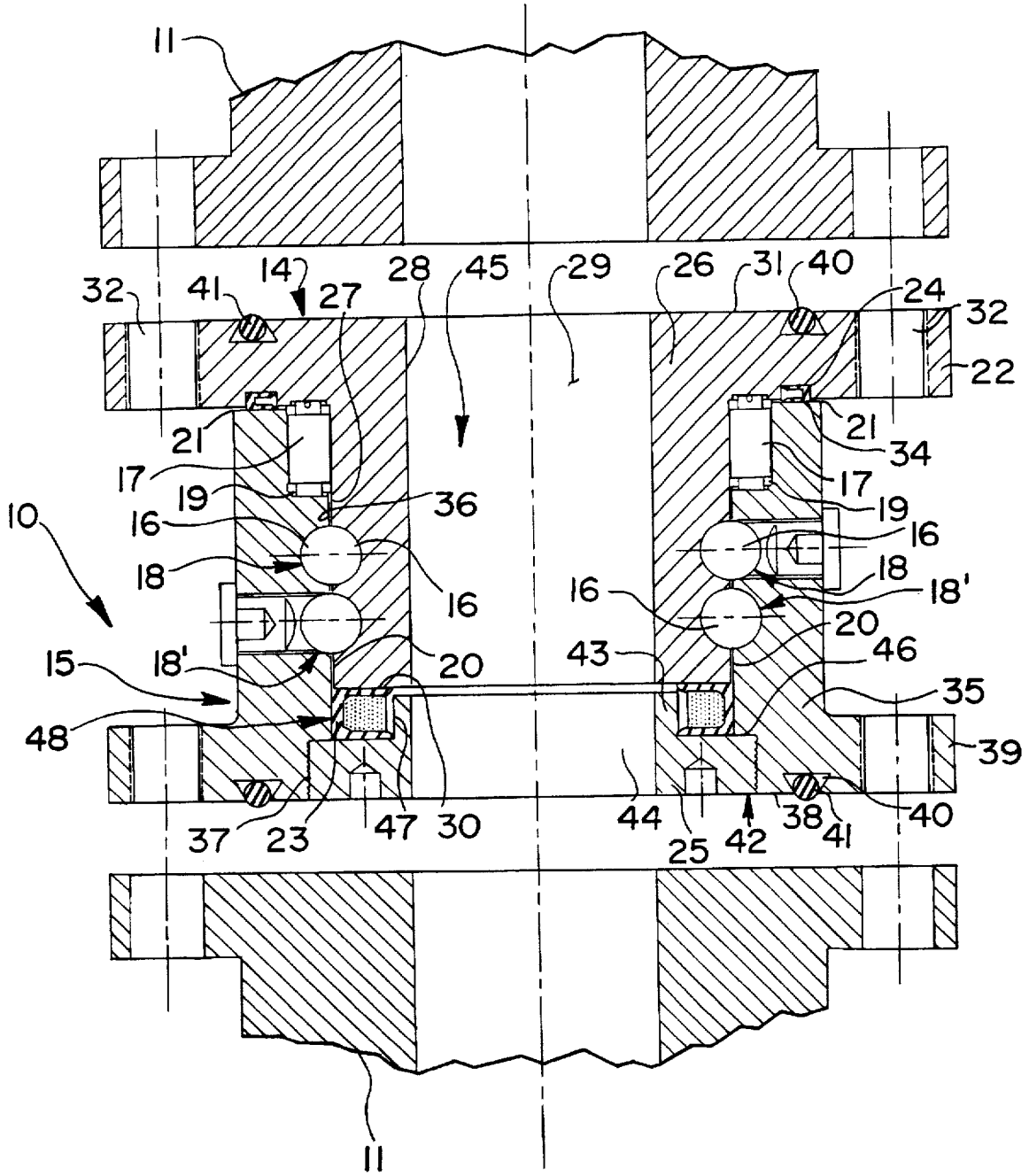
FIG. 2 is a longitudinal sectional view of the vortex burning chamber of the present invention, taken along the line 2—2 of FIG. 1 and drawn to an enlarged scale.
Figure 3:
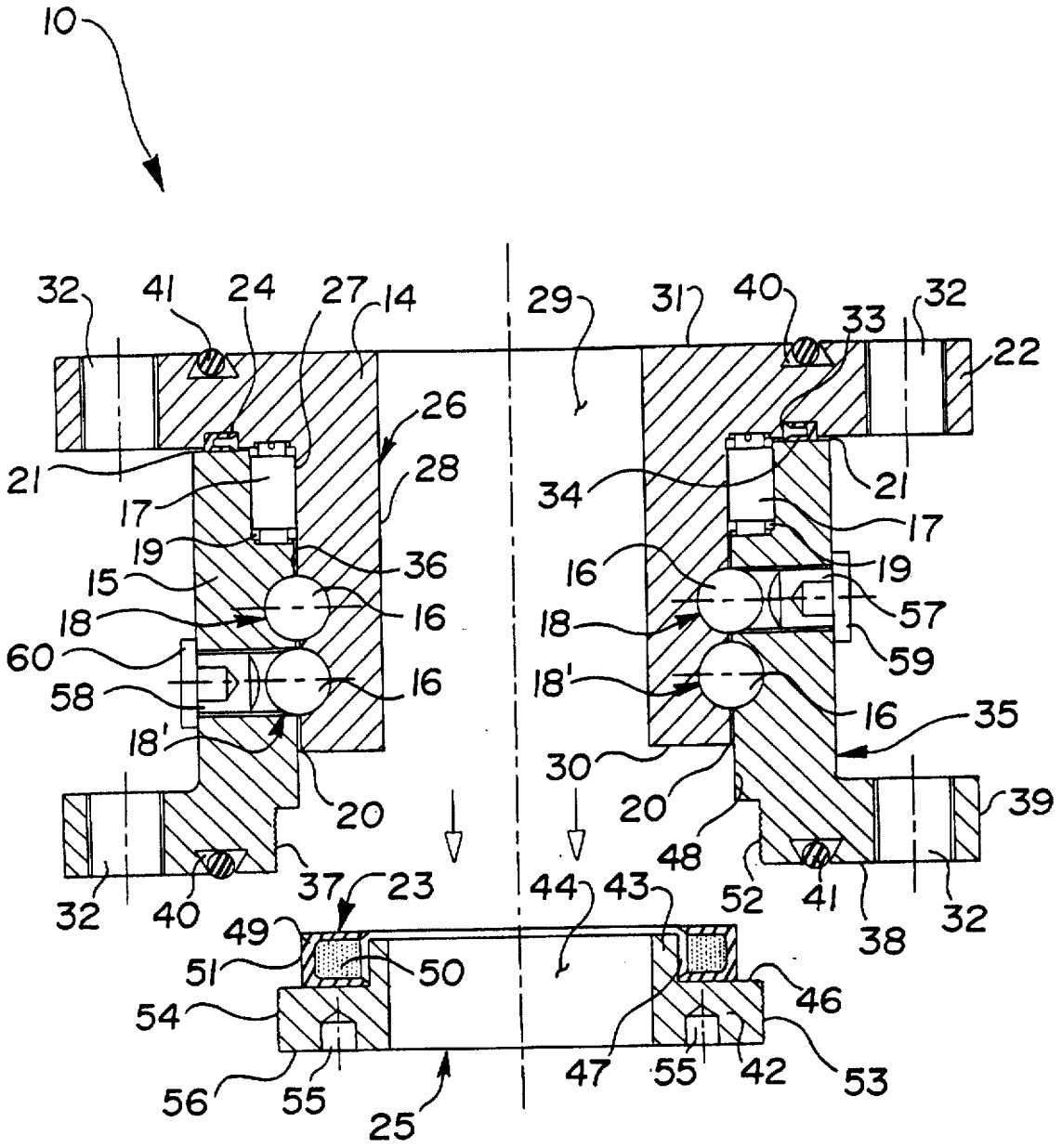
FIG. 3 is another longitudinal sectional view of the vortex burning chamber of the present invention, taken along the lines 3—3 of FIG. 2.
Figure 4:
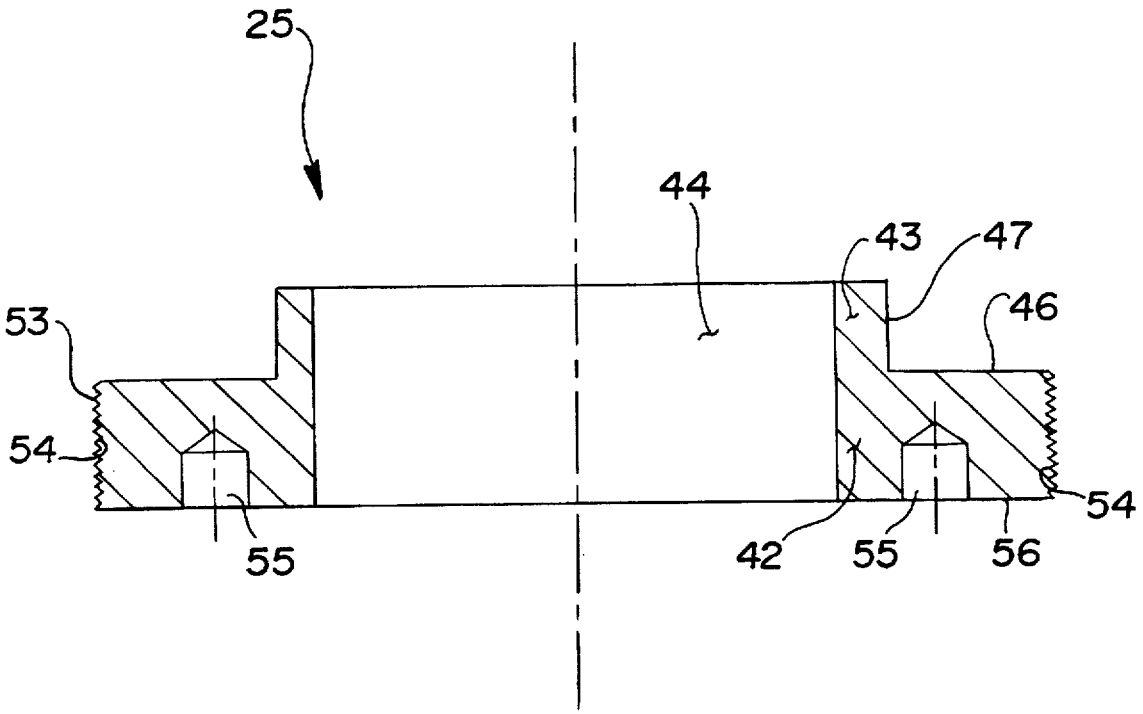
FIG. 4 is a partial view of the process chamber of FIG. 1 drawn to an enlarged scale, and showing the system grate of the present invention.

The two-stage vortex burning chamber 12 is composed of an a vertical cylindrical chamber 36 arranged at right angle to the horizontal chamber 35 and connected to each other. As best shown in FIGS. 2 and 3, both horizontal and vertical chambers 35 and 36 are lined with an insulation layer 37 and a refractory concrete layer. The horizontal chamber 35 includes a refractory jacket 37 and a double-walled steel jacket 38. The incompletely burnt gas from the process chamber 11 enters the horizontal chamber 35 through an inlet 39. An air required for the initial stage of combustion—primary air 40—is supplied into the horizontal chamber 35 through a pipe 41 and prior to injection into the horizontal chamber 35, passes through the jacket 38 and refractory jacket 37 where it undergoes pre-heating. At the same time, the steel jacket 38 is cooled down by means known by those skilled in the art, hence heat energy is recovered.

As best shown in FIGS. 2 and 3, the primary air 40 is injected into the horizontal chamber 35 at high pressure through numerous drill holes 42 provided across the whole surface of the jacket 37. In the horizontal chamber 35 the injected primary air 40 injected at right angle upon the incompletely burnt gas 32 (gas of pyrolysis and/or lean gas) acceding through the inlet 39, thereby enabling an optional vortex and mingling of the incompletely burnt gas 32 and the primary air 40. The primary air 40 is added to the gas 32 at a slightly substoichiometric ratio (lambda–0.9). When the primary air 40 impinges upon the gas 32, a gas/air mixture is ignited and undergoes incomplete oxidation at about 1600° F. The gas/air mixture converges into a tangentially directed current at the far end of the horizontal chamber 35 and is discharged into the vertical chamber 36 through a bottleneck 43. Entering the vertical chamber 36, the turbulent gas/air mixture continues to circulate at high velocity. Any solids which are carried along the turbulent gas/air mixture, are forced against walls 44 of the vertical chamber 36 by centrifugal forces, and than are forced downwards by gravity forces.

There is an increased crossed-sectional area 45 in a bottom portion of the vertical chamber 36. The area 45 serves as a collecting zone for solids and has a ring-shaped ledge 46 which forms a no-flow zone preventing the solids collected in the area 45 from being whirled up and returned to a main oxidation area 47 of the vertical chamber 36. The collected solids (ashes and inert matters), can be disposed of through an inspection opening 48.

A secondary air 49 required for complete oxidation at the gas/air mixture is injected tangentially into the vertical chamber 36 through a secondary air inlet 50. The secondary air 49 being injected, intermingles with incompletely oxidized gas ingressing through the bottleneck 43. The secondary air 49 is added to the gas 32 at a slightly suprastoichiometric ratio (lambda 1.2), thereby ensuring the gas 32 to be burnt out completely at about 1850° F. in the vertical chamber 36.

A pilot burner 51 is integrated in a supplemental compartment 52 of the vertical chamber 36. The pilot burner 51 is mounted in such a way as to pass it through the jacket of the vertical chamber 36, with its head pointing towards, and communicating with, the main oxidation area 47 of the vertical chamber 36. The pilot burner 51 enables the vertical chamber 36 to be pre-heated, prior to the admission of the gas/air mix to an appropriate ignition temperature, thus ensuring combustion of the gas/air mix to begin without delay, i.e. right from the very moment of ignition, thus reducing the formation of harmful substances to a minimum.

The waste gas 53 formed in the upper portion of the vertical chamber 36 is discharged through a waste-gas exhaust pipe 54, which is co-axial with the axis A—A of the vertical chamber 36. Entering end 55 of the waste-gas exhaust pipe 54 which connects the waste-gas exhaust pipe 54 with the main oxidation area 47 exhibits a smaller flow cross section 56 than exiting and 57 of the waste-gas exhaust pipe 54. The entering end 55 might assume the form of a nozzle or lip, thus causing the flow cross section 56 to diverge in a Laval-type-nozzle shape, all along the length of the pipe 54. The resulting acceleration, and stabilization, of the waste-gas 53 current arriving from the main oxidation area 47 of vortex burning chamber 12 have a further intermixing effect on the waste-gas 53 current, hence enhance the burn-out efficiency. The waste gas 53 is discharged, from the exiting end 57 into a heat exchanger (not shown) or, if the energy of the waste gas 53 is not needed, into the mixing chamber of a venturi blower (not shown).

Figure 5:
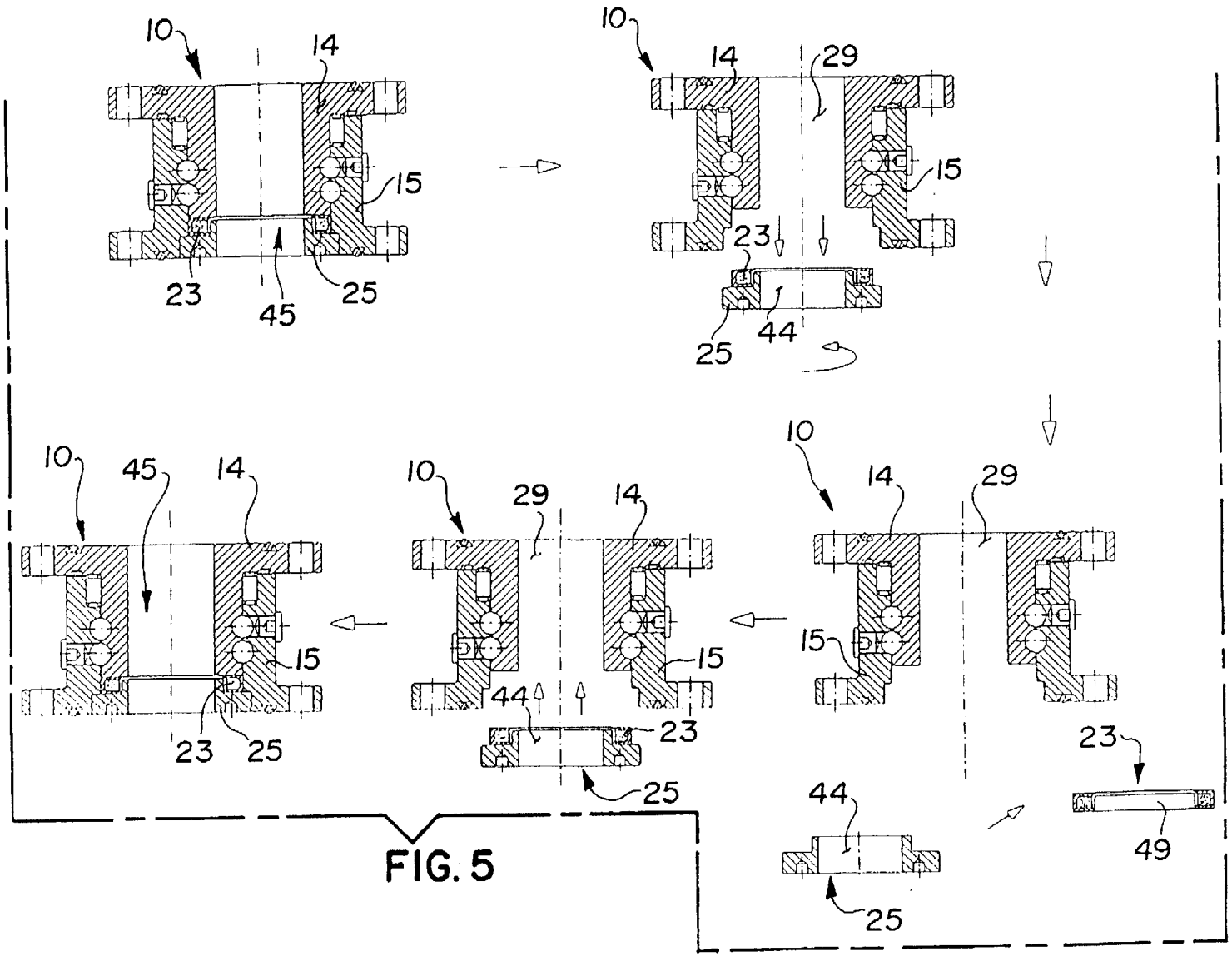
FIG. 5 is a top view of the system grate.
Figure 6:
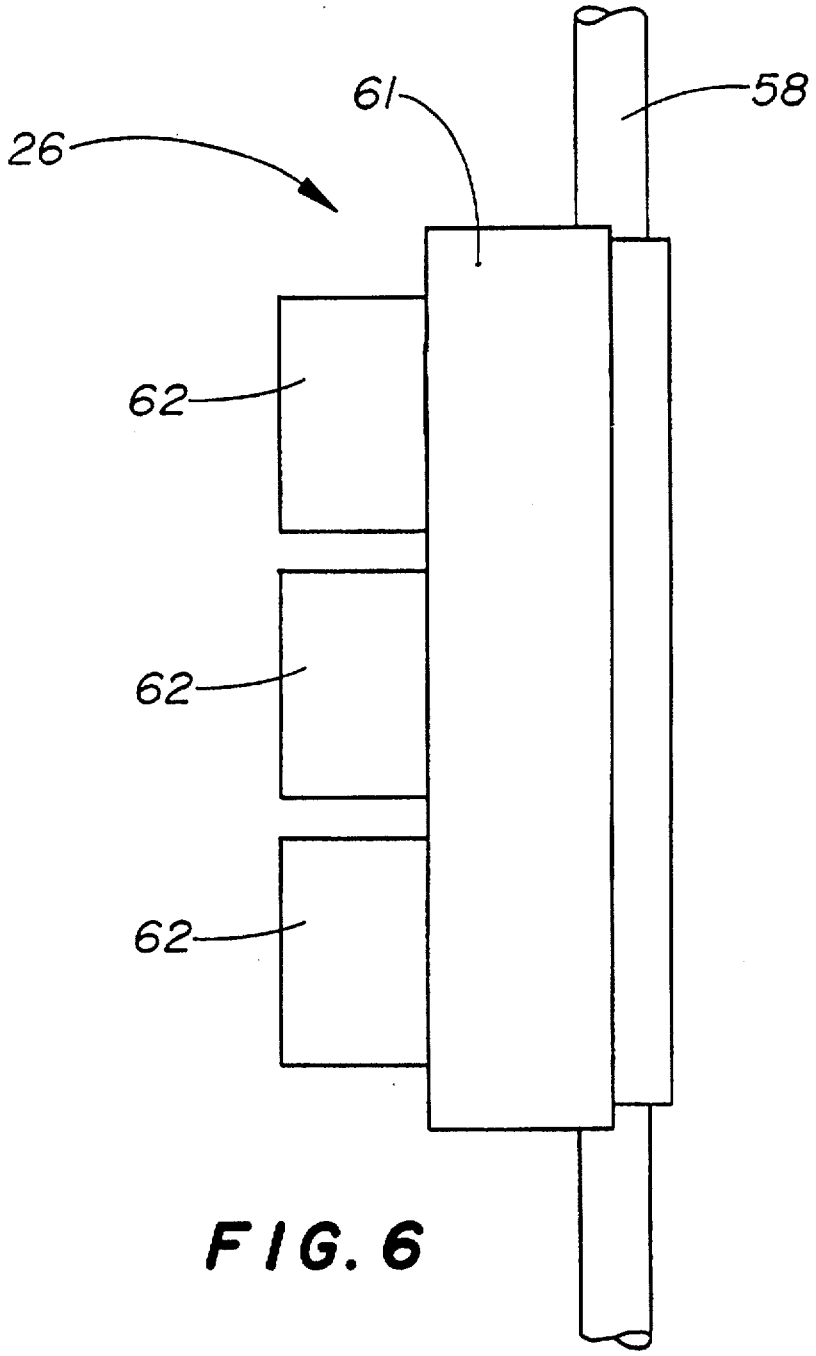
FIG. 6 is a side elevational view thereof.
Figure 1:
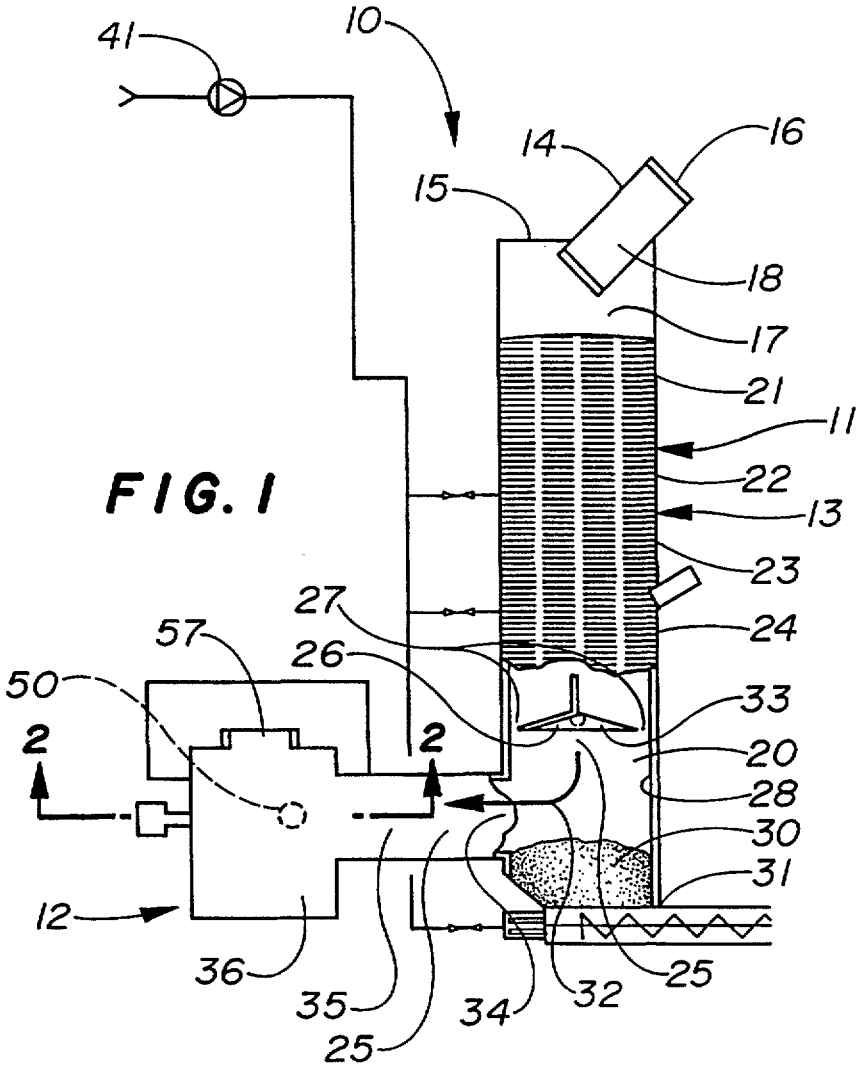
Figure 2:
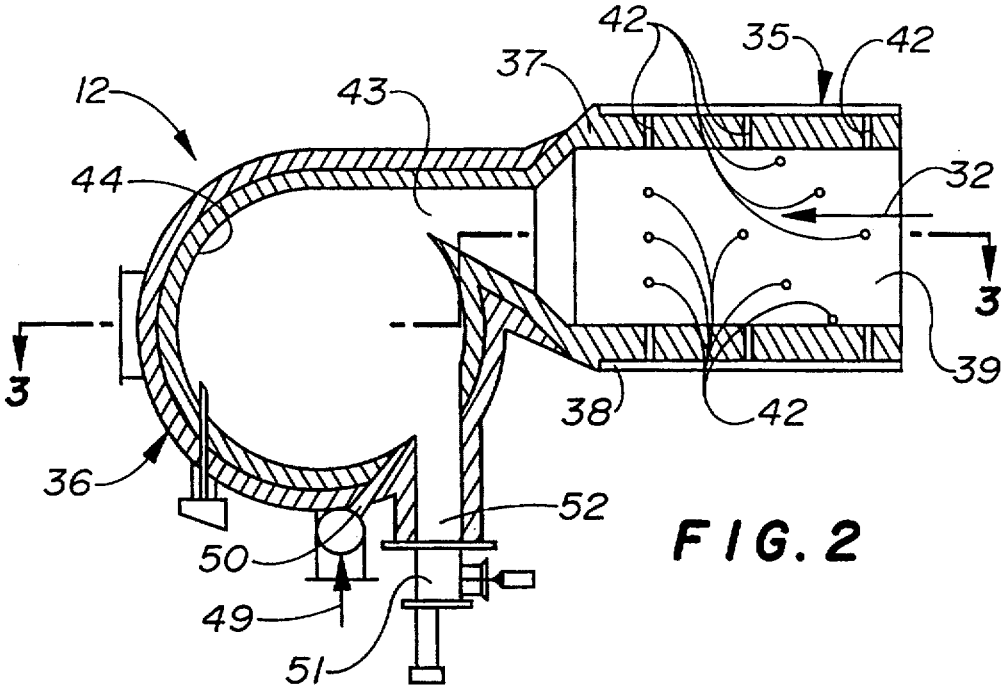
Figure 3:
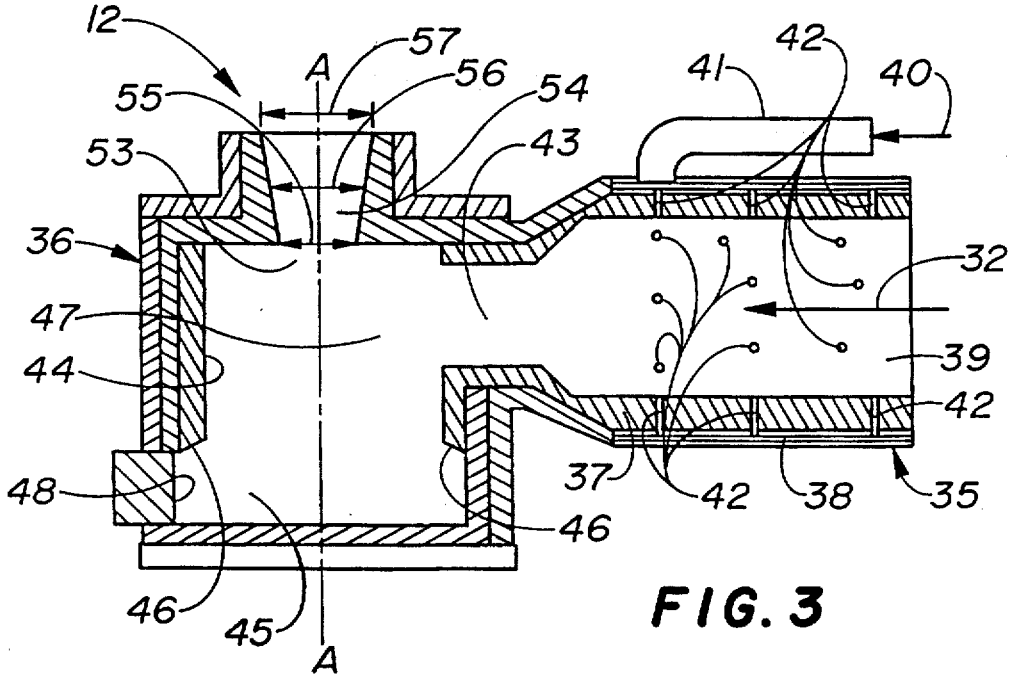
Figure 4:
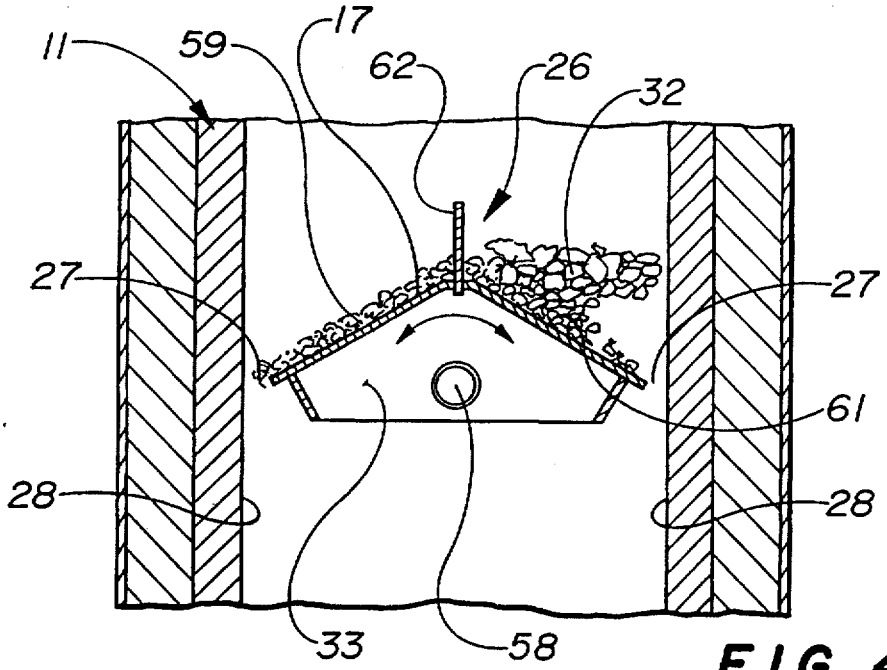
Figure 5:
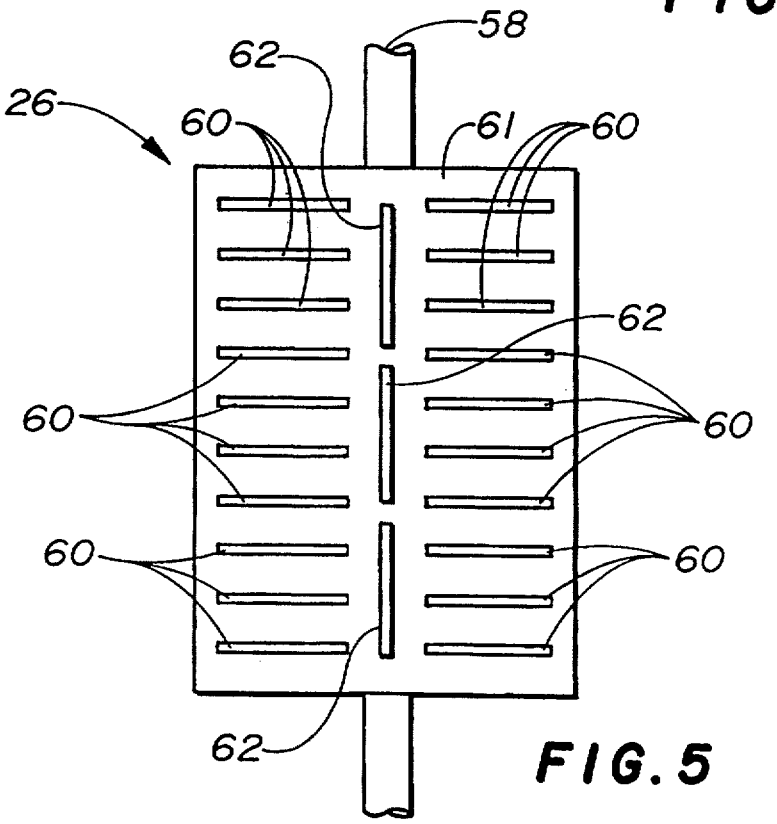
Figure 6:
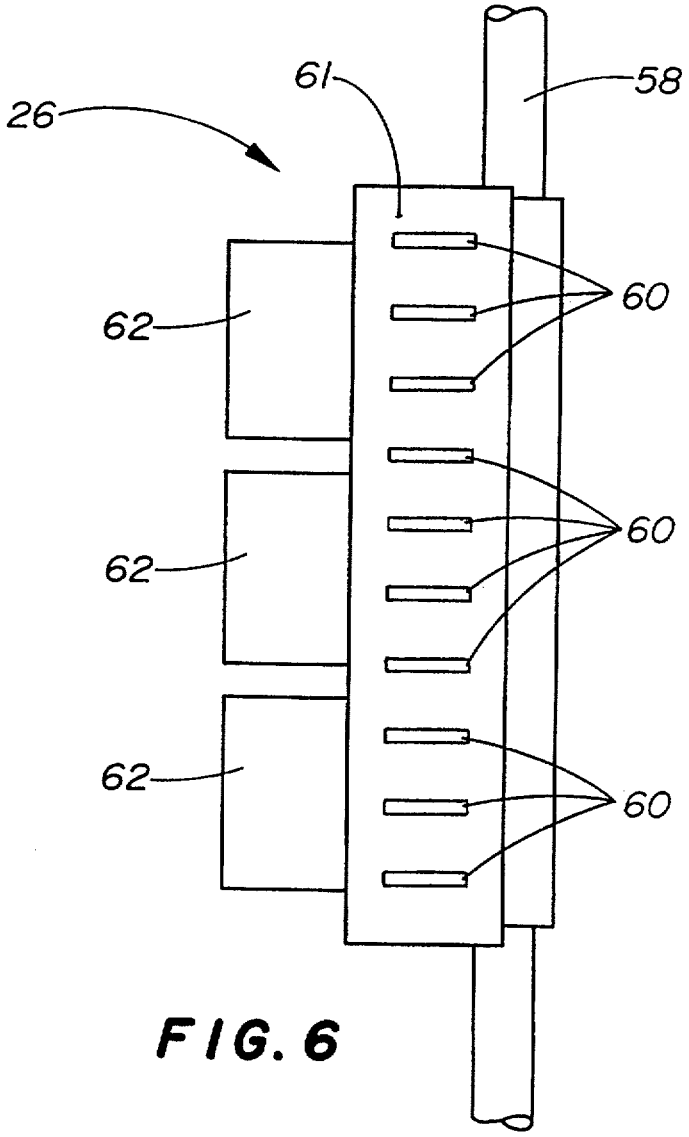
Figure 1:
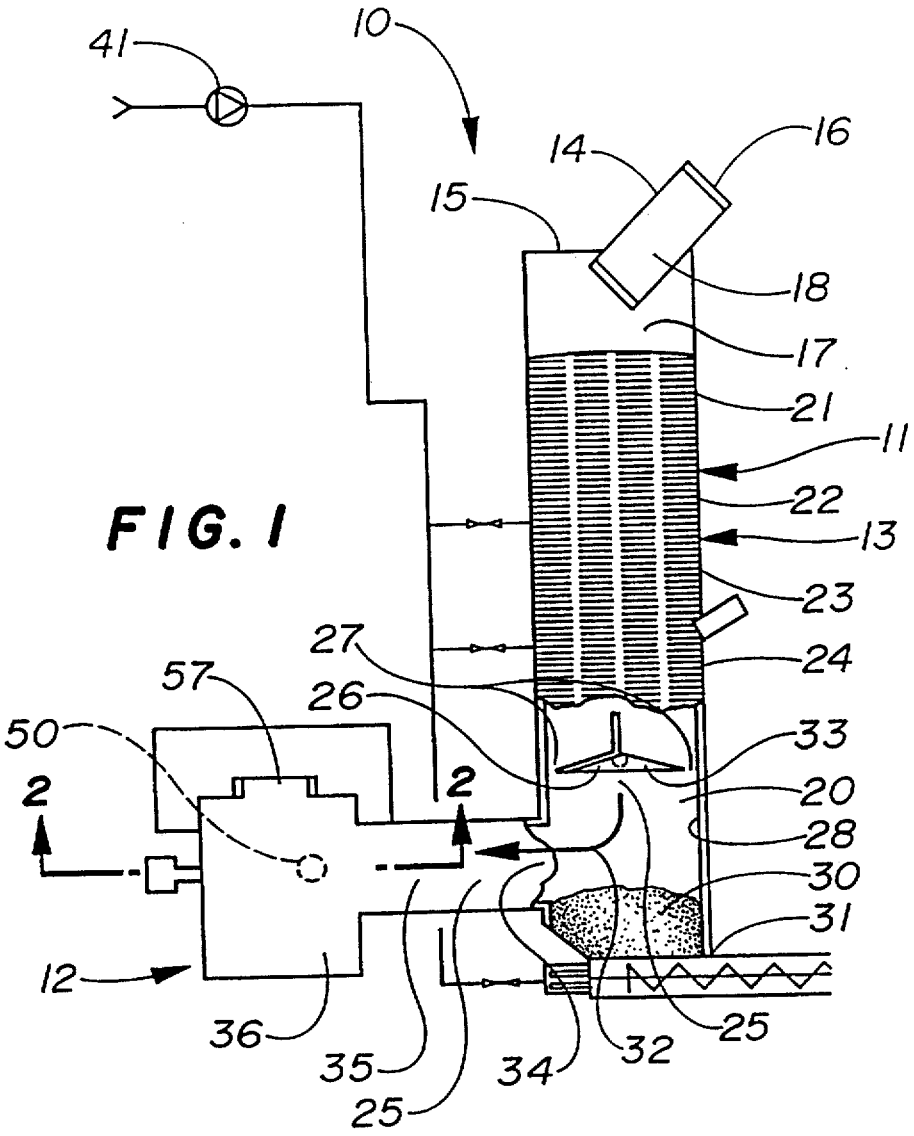
Figure 2:
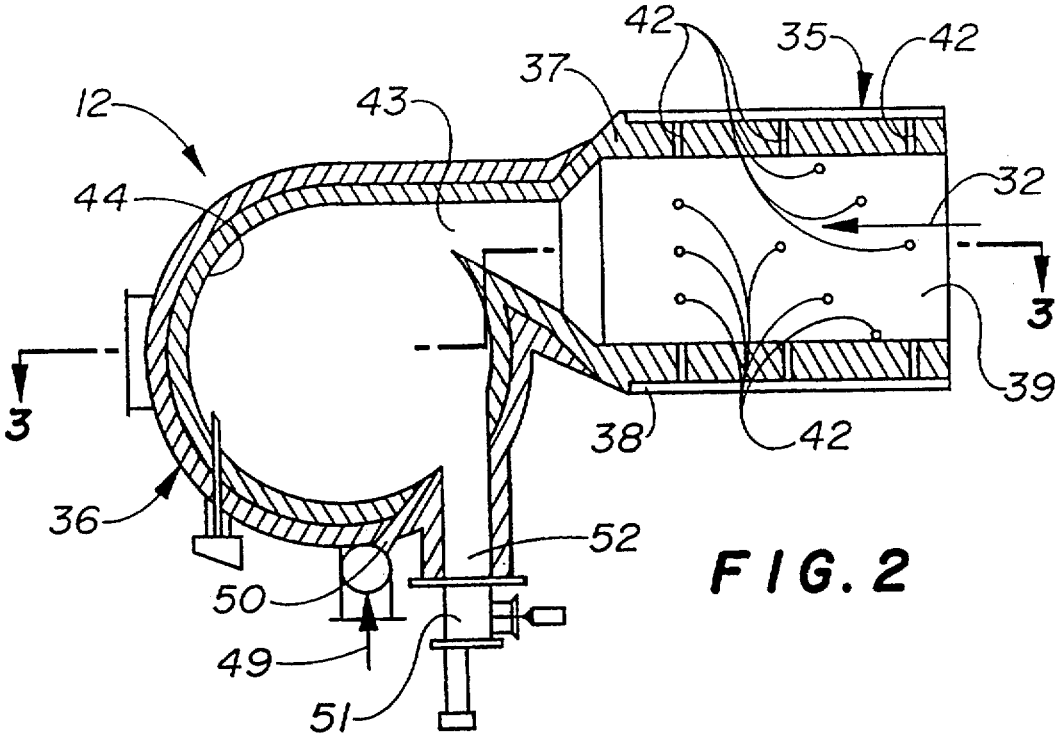
Figure 3:
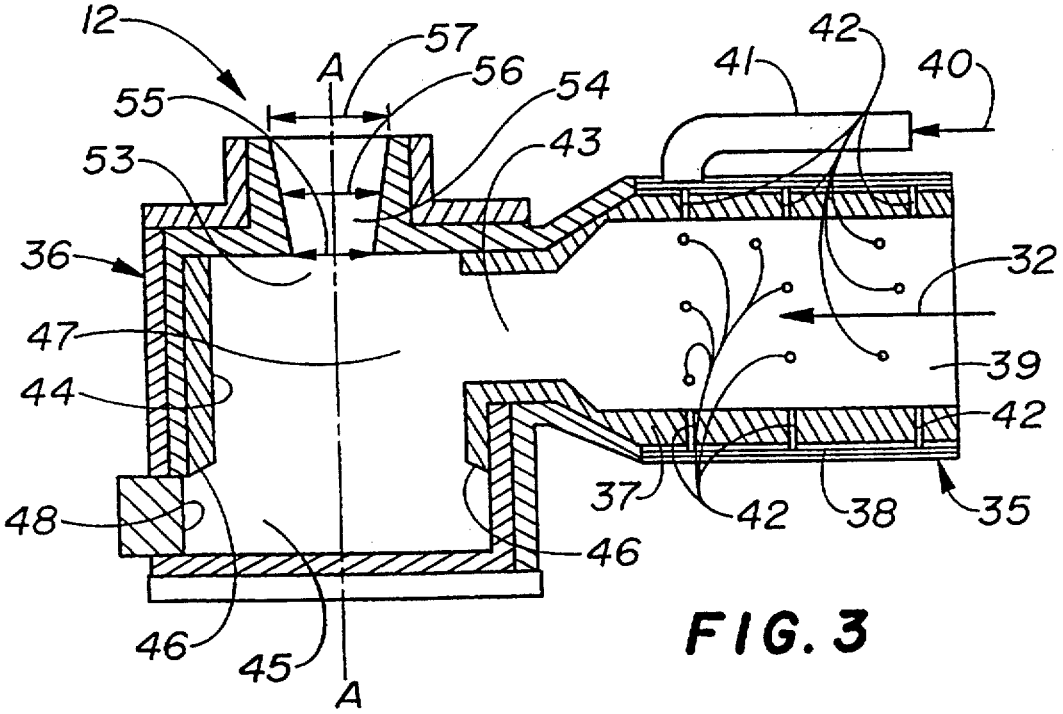
Figure 4:
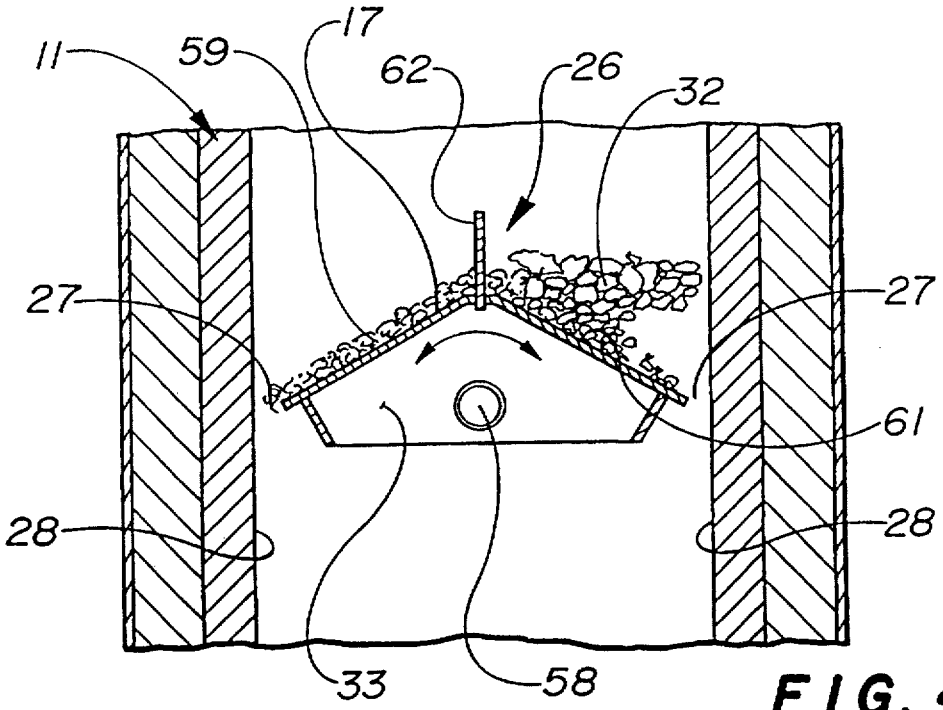
Figure 5:
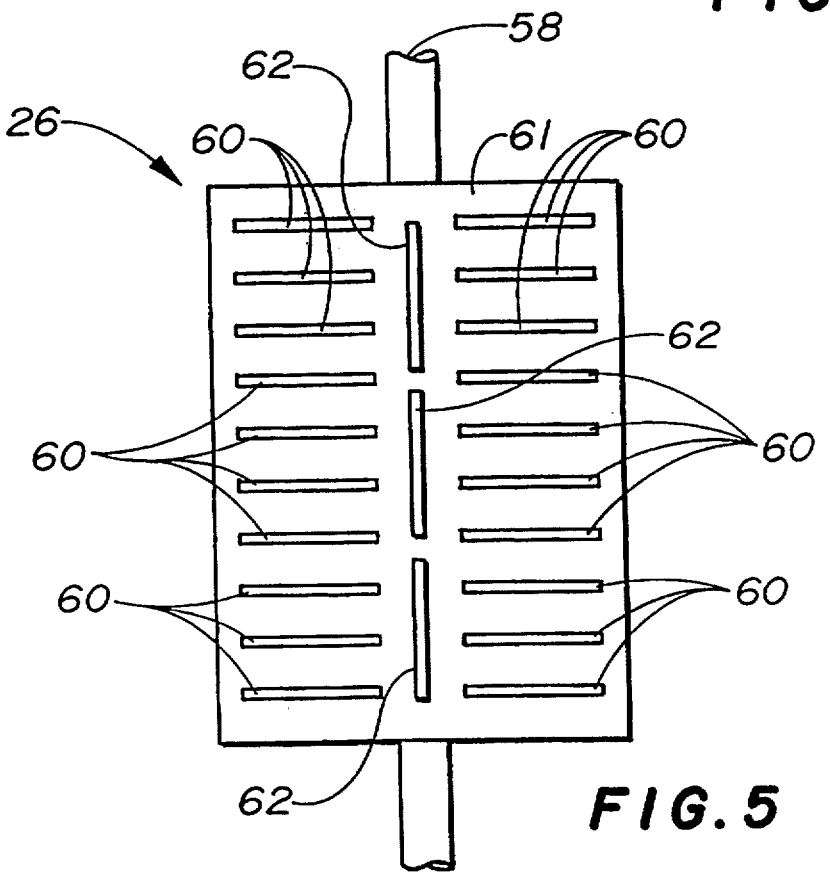
Figure 6:
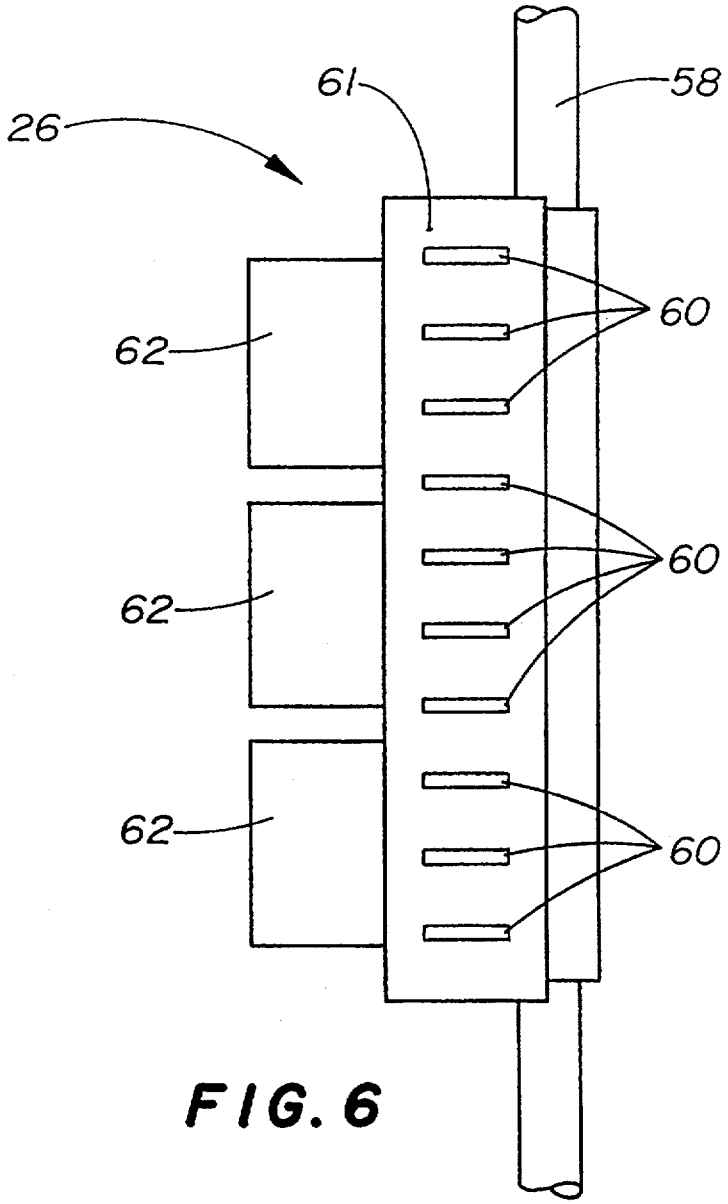

As best shown in FIGS. 1 and 4–6, the system grate 26 is mounted in the lower third of the process chamber 11. It serves as an accumulation element for the vertical waste column. The system grate 26 is supported and is pivoted by an axle 58, hence is tiltable. By tilting in both directions (FIG. 4) the ashes, inert matters, and the carbon 59 resting against the system grate 26 would fall through the gap 27 arranged both between the system grate 26 and the walls 28 and the slots 60 in the system grate 26 itself (FIG. 5).

The gaseous products existing in the compartment on top of the system grate 26 are also drawn off, again through the gap 27 and the slots 60 in the roof 61 of the system grate 26, to be subsequently oxidized in the Vortex burning chamber 12. The system grate 26 includes a gasification and a cracking zone (the coke bed 33). The gases, while passing through the slots 60 in the grate system 26, are cracked on the coke bed 33 and while being exposed to progressively increasing heat, form short-chain hydrocarbon molecules (methane), the latter being readily and completely burnt in the subsequent combustion stage in the vortex burning chamber 12. As a result of the reaction between carbon and oxygen on the system grate 26 (the gasification), carbon monoxide is produced. Therefore, the incompletely burnt gas to be supplied to the horizontal chamber 35 of the two-stage vortex burning chamber 12 includes carbon monoxide, short-chain hydrocarbon molecules (methane) and a small amount of hydrogen, which is also a product of the cracking process. This mixture of gases is the lean gas, which is produced by the process chamber 11 of the present invention. The two-stage vortex burning chamber 12 is designed specifically as an oxidation chamber for the lean gas produced by the process chamber 11.

The two-stage vortex burning chamber is also designed to be used in combination with other types of "gas generators" (process chambers) producing gas with low calorific value, i.e. pyrolysis plants. A further effect of the motion of the system grate 26 is enhanced by as a paddle 62 mounted on the roof 61 of the system grate 26. The paddle 62 being forced and passing through the waste column, thus stirring it up and making it more homogeneous, and thus enabling the waste materials 17 to be conveyed ("slidedown") even more readily from the vertical furnace 13 into the compartment below.

The roof 61 of the system grate 26 is shaped as a 30°-angled roof which makes the ashes and inert matters slide down even more readily into the ash afterburning chamber 29 arranged underneath the system grate 26.

The system of the present invention, as described above, provides the following advantages:

low pollution level of the waste materials treatment;

complete combustion leaving behind just a minimum of ashes which are collected in the area 45 of the vortex burning chamber 12;

the solids are not subjected to high temperatures, hence less sagging is produced;

high temperatures in the vortex burning chamber 12, hence a good burn-out of the incompletely burnt gas and low emission level is attained (primary and secondary in the vortex burning chamber and primary in the process chamber);

Optimal air control, hence optimal process control is reached;

Possibility of energy utilization at heat exchangers.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A vertical furnace receiving waste materials for treatment comprising a system grate for collecting and conveying therethrough solid and gaseous products for treatment, said system grate being situated over a coke bed, having an angled flat roof, and also being pivoted for tilting to and fro on an axle within the vertical furnace, said roof having slots;

respective spaces being provided around the system grate between the system grate and the walls of the vertical furnace;

a plurality of paddles being mounted on said roof to provide homogenization and mixing of the solid products, to thereby convey said gaseous products and any solid products collected on said roof through said slots and said spaces around the system grate.

* * * * *

UNITED STATES PATENT AND TRADEMARK OFFICE

CERTIFICATE OF CORRECTION

PATENT NO. : 5,746,142

DATED : May 5, 1998

INVENTOR(S) : Jennebach et al.

It is certified that error appears in the above-identified patent and that said Letters Patent is hereby corrected as shown below:

The title page should be deleted to appear as per attached title page.

Please delete drawing sheets 1-6 and substitute drawing sheets 1-4 as per attached.

Signed and Sealed this

First Day of June, 1999

*Attest:*

*Attesting Officer*

Q. TODD DICKINSON

*Acting Commissioner of Patents and Trademarks*

United States Patent [19]

Jennebach et al.

[11] Patent Number: 5,746,142

[45] Date of Patent: May 5, 1998

[54] HORIZONTALLY PIVOTED SYSTEM GRATE FOR A FURNACE

[75] Inventors: Markus Jennebach, Dachau, Germany; Joao Augusto Birkhan, Viamao-RS, Brazil

[73] Assignees: Leslie Technologies, Inc., Tallahassee, Fla.; Gruntec LTDA, Brazil

[21] Appl. No.: 746,641

[22] Filed: Nov. 13, 1996

Related U.S. Application Data

[62] Division of Ser. No. 399,847, Mar. 7, 1995, Pat. No. 5,588,381.

[51] Int. Cl.[6] ..... F23G 5/00; F23G 5/24

[52] U.S. Cl. ..... 110/248; 110/255; 110/267; 110/268; 110/275

[58] Field of Search ..... 110/268, 275, 110/276, 277, 285, 328, 247, 248, 255

[56] References Cited

U.S. PATENT DOCUMENTS

| | | | |
|---|---|---|---|
| 814,650 | 3/1906 | Harchatick | 110/275 |
| 1,173,693 | 2/1916 | Wingen | 110/275 |
| 1,903,634 | 4/1933 | Robinson | 110/275 |
| 1,984,045 | 12/1934 | Steere | 110/328 |
| 2,017,340 | 10/1935 | Corbett | 110/275 |
| 2,289,347 | 7/1942 | Daae | 110/275 |
| 2,393,422 | 1/1946 | Schneider | 110/275 |
| 2,747,526 | 5/1956 | Seidl | 110/28 |
| 3,645,218 | 2/1972 | Davis | 110/8 R |
| 4,026,223 | 5/1977 | Robbins | 110/7 B |
| 4,116,136 | 9/1978 | Mallek et al. | 110/251 |
| 4,184,437 | 1/1980 | Mallek et al. | 110/251 |
| 4,194,455 | 3/1980 | Mallek et al. | 110/251 |
| 4,261,269 | 4/1981 | Mallek et al. | 110/251 |
| 4,424,755 | 1/1984 | Caffyn et al. | 110/246 |
| 4,498,909 | 2/1985 | Milner et al. | 48/209 |
| 4,516,510 | 5/1985 | Basic, Sr. | 110/346 |
| 4,544,374 | 10/1985 | Mallek et al. | 48/114 |
| 4,561,363 | 12/1985 | Mallek | 110/229 |
| 4,655,146 | 4/1987 | Lemelson | 110/346 |
| 4,700,637 | 10/1987 | McCartney | 110/237 |
| 4,785,746 | 11/1988 | Roy et al. | 110/347 |
| 4,800,824 | 1/1989 | DiFonzo | 110/235 |
| 4,800,825 | 1/1989 | Kuenzly | 110/345 |

(List continued on next page.)

FOREIGN PATENT DOCUMENTS

| | | |
|---|---|---|
| 451095 | 9/1948 | Canada . |
| 1673783 A1 | 8/1991 | U.S.S.R. . |

*Primary Examiner*—Ira S. Lazarus
*Assistant Examiner*—Ljiljana V. Ciric
*Attorney, Agent, or Firm*—Leonard Bloom

[57] ABSTRACT

A low-pollutant system for waste materials treatment includes a process chamber for converting organic components of the waste materials into a flammable gas and a two-stage vortex burning chamber for complete combustion of the flammable gas. The vortex burning chamber includes a first substantially-horizontal combustion chamber and a second substantially-vertical combustion chamber disposed at a right angle to each other and communicating therebetween. The first combustion chamber has an inlet portion for receiving the flammable combustion gas from the gas generator means for injecting primary air into the first combustion chamber, thereby forming a mixture of air and the flammable gas and thereby igniting the mixture for partial oxidation thereof. The first combustion chamber has a converging distal portion for discharging the partially-oxidized mixture of air and the flammable gas tangentially into the second combustion chamber, where the gas is mixed with the secondary air which is injected tangentially into the second combustion chamber, thereby substantially completely oxidizing the partially-oxidized mixture of air and the flammable gas. The second combustion chamber has an outlet portion for discharge of the waste gas resulting from the two-stage combustion of the flammable gas and the solids separated from the gas. The system has a pivoting grate with an angled flat roof with slots and paddles; and a coke bed for the cracking of pyrolysis of gases disposed under said roof.

1 Claims, 3 Drawing Sheets

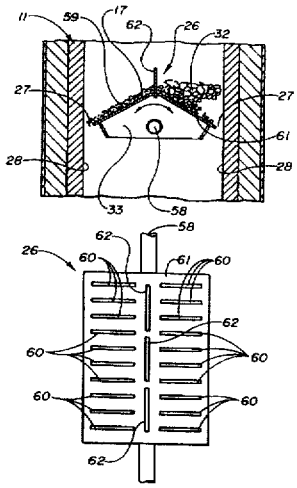

UNITED STATES PATENT AND TRADEMARK OFFICE

CERTIFICATE OF CORRECTION

PATENT NO. : 5,746,142

DATED : May 5, 1998

INVENTOR(S) : Jennebach et al.

It is certified that error appears in the above-identified patent and that said Letters Patent is hereby corrected as shown below:

The title page should be deleted to appear as per attached title page.

Please delete drawing sheets 1-6 and substitute drawing sheets 1-4 as per attached.

This certificate supersedes Certificate of Correction issued June 1, 1999.

Signed and Sealed this

Twentieth Day of July, 1999

*Attest:*

*Attesting Officer*

Q. TODD DICKINSON

*Acting Commissioner of Patents and Trademarks*

United States Patent [19]

Jennebach et al.

[11] Patent Number: 5,746,142

[45] Date of Patent: May 5, 1998

[54] HORIZONTALLY PIVOTED SYSTEM GRATE FOR A FURNACE

[75] Inventors: Markus Jennebach, Dachau, Germany; Joao Augusto Birkhan, Viamao-RS, Brazil

[73] Assignees: Leslie Technologies, Inc., Tallahassee, Fla.; Gruntec LTDA, Brazil

[21] Appl. No.: 746,641

[22] Filed: Nov. 13, 1996

Related U.S. Application Data

[62] Division of Ser. No. 399,847, Mar. 7, 1995, Pat. No. 5,588,381.

[51] Int. Cl.[6] ..... F23G 5/00; F23G 5/24

[52] U.S. Cl. ..... 110/248; 110/255; 110/267; 110/268; 110/275

[58] Field of Search ..... 110/268, 275, 110/276, 277, 285, 328, 247, 248, 255

[56] References Cited

U.S. PATENT DOCUMENTS

| | | | |
|---|---|---|---|
| 814,650 | 3/1906 | Harchanick | 110/275 |
| 1,173,693 | 2/1916 | Wingen | 110/275 |
| 1,903,634 | 4/1933 | Robinson | 110/275 |
| 1,984,045 | 12/1934 | Steere | 110/328 |
| 2,017,340 | 10/1935 | Corbett | 110/275 |
| 2,289,347 | 7/1942 | Daae | 110/275 |
| 2,393,422 | 1/1946 | Schneider | 110/275 |
| 2,747,526 | 5/1956 | Seidl | 110/28 |
| 3,645,218 | 2/1972 | Davis | 110/8 R |
| 4,026,223 | 5/1977 | Robbins | 110/7 B |
| 4,116,136 | 9/1978 | Mallek et al. | 110/251 |
| 4,184,437 | 1/1980 | Mallek et al. | 110/251 |
| 4,194,455 | 3/1980 | Mallek et al. | 110/251 |
| 4,261,269 | 4/1981 | Mallek et al. | 110/251 |
| 4,424,755 | 1/1984 | Caffyn et al. | 110/246 |
| 4,498,909 | 2/1985 | Milner et al. | 48/209 |
| 4,516,510 | 5/1985 | Basic, Sr. | 110/346 |
| 4,544,374 | 10/1985 | Mallek et al. | 48/114 |
| 4,561,363 | 12/1985 | Mallek | 110/229 |
| 4,655,146 | 4/1987 | Lemelson | 110/346 |
| 4,700,637 | 10/1987 | McCartney | 110/237 |
| 4,785,746 | 11/1988 | Roy et al. | 110/347 |
| 4,800,824 | 1/1989 | DiFonzo | 110/235 |
| 4,800,825 | 1/1989 | Kuenzly | 110/345 |

(List continued on next page.)

FOREIGN PATENT DOCUMENTS

| | | |
|---|---|---|
| 451095 | 9/1948 | Canada . |
| 1673783 A1 | 8/1991 | U.S.S.R. . |

*Primary Examiner*—Ira S. Lazarus
*Assistant Examiner*—Ljiljana V. Ciric
*Attorney, Agent, or Firm*—Leonard Bloom

[57] ABSTRACT

A low-pollutant system for waste materials treatment includes a process chamber for converting organic components of the waste materials into a flammable gas and a two-stage vortex burning chamber for complete combustion of the flammable gas. The vortex burning chamber includes a first substantially-horizontal combustion chamber and a second substantially-vertical combustion chamber disposed at a right angle to each other and communicating therebetween. The first combustion chamber has an inlet portion for receiving the flammable combustion gas from the gas generator means for injecting primary air into the first combustion chamber, thereby forming a mixture of air and the flammable gas and thereby igniting the mixture for partial oxidation thereof. The first combustion chamber has a converging distal portion for discharging the partially-oxidized mixture of air and the flammable gas tangentially into the second combustion chamber, where the gas is mixed with the secondary air which is injected tangentially into the second combustion chamber, thereby substantially completely oxidizing the partially-oxidized mixture of air and the flammable gas. The second combustion chamber has an outlet portion for discharge of the waste gas resulting from the two-stage combustion of the flammable gas and the solids separated from the gas. The system has a pivoting grate with an angled flat roof with slots and paddles; and a coke bed for the cracking of pyrolysis of gases disposed under said roof.

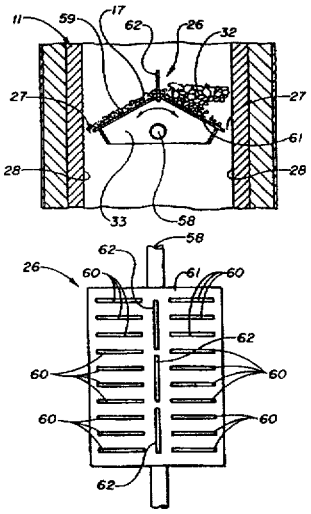

1 Claims, 4 Drawing Sheets